US005551694A

United States Patent [19]

Grim, Jr. et al.

[11] Patent Number: 5,551,694

[45] Date of Patent: Sep. 3, 1996

[54] SOUNDING GOLF PUTTER

[76] Inventors: J. Lawrence Grim, Jr., 717H W. Callohill Rd., Perkasie, Pa. 18944; Jacob H. Malta, 223 N. Shady Retreat, New Britain, Pa. 18901

[21] Appl. No.: 491,106

[22] Filed: Jun. 16, 1995

[51] Int. Cl.[6] ..... A63B 69/36

[52] U.S. Cl. ..... 473/234; 473/329; 473/341; 473/350

[58] Field of Search ..... 273/78, 162 E, 273/186.2; 473/198, 219, 224, 226, 231, 234, 324, 329, 332, 256, 341, 350

[56] References Cited

U.S. PATENT DOCUMENTS

| | | | |
|---|---|---|---|
| 4,123,056 | 10/1978 | Nakamatsu | 273/78 |
| 4,138,117 | 2/1979 | Dalton | 273/78 X |
| 4,361,329 | 11/1982 | Brock | 273/162 E |
| 5,160,144 | 11/1992 | Maniatis | 273/78 X |
| 5,346,219 | 9/1994 | Pehoski et al. | 273/78 X |

*Primary Examiner*—George J. Marlo
*Attorney, Agent, or Firm*—Gregory J. Gore

[57] ABSTRACT

A golf putter includes a rigid mid-section and two parallel, opposing tone-generating tines on either side. The tone generators are each held at the toe of the club head, being formed as an integral extension of a central member by cuts through the club head. Thus, a volume and quality of sound can be produced from a relatively thick striking face plate which has minimum flexure to produce accurate golf putting. Because the structure is symmetrical, it is reversible for use by both left and right-handed golfers. The sound-producing tines may alternately both be placed on the rear side of the club head away from the striking surface. In this case, the sound-producing tines may be of different lengths so each tine produces different tonal frequencies that are preferably mutual tonal harmonics.

9 Claims, 2 Drawing Sheets

FIG.1
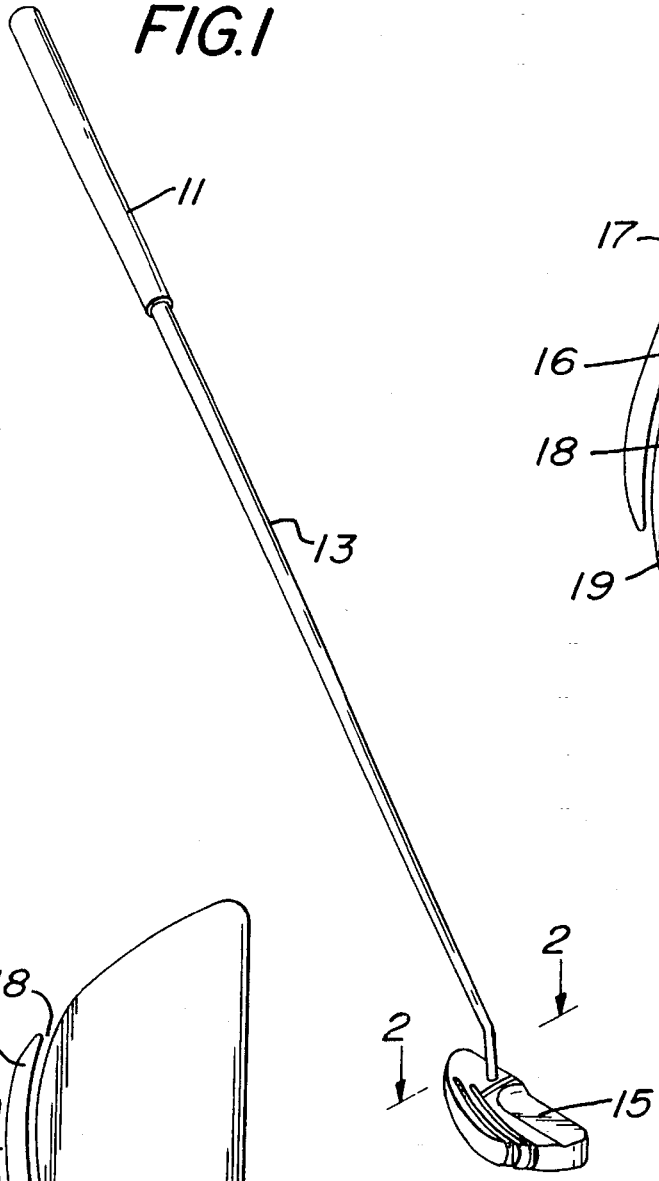
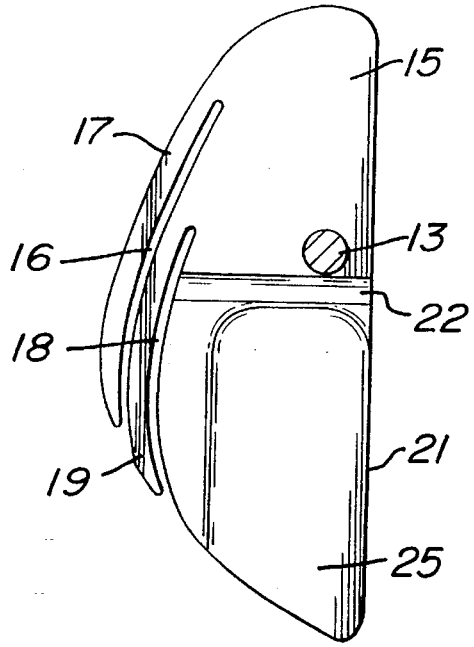
FIG.2
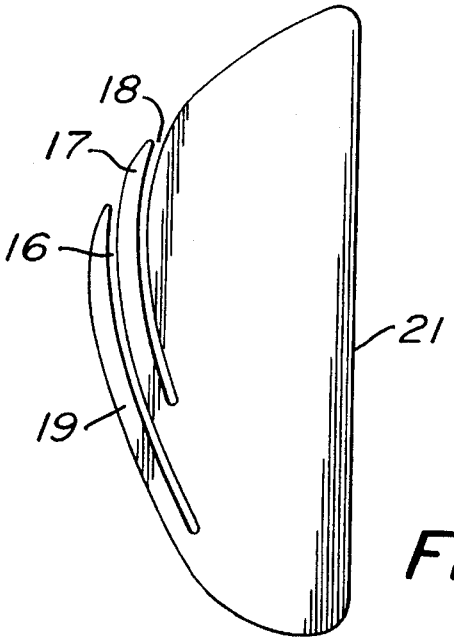
FIG.3

SOUNDING GOLF PUTTER

FIELD OF THE INVENTION

The present invention relates to golfclubs, namely, a golf putter. More specifically, it relates to a golf putter that produces a distinctive musical tone when the golfball is struck.

BACKGROUND OF THE INVENTION AND DESCRIPTION OF PRIOR ART

It has long been known that the sound a golf putter makes when it strikes the golfball is important to enhance the use of the putter. This sound-producing characteristic may be desirable, both for aesthetic reasons to make using the golf putter more enjoyable, or for functional reasons to help determine whether the proper area of the club head strikes the golfball. Using touch and sound, a golfer can develop a reproducible and therefore more accurate putting stroke.

Prior art references which disclose sounding golf putter heads are, for example, U.S. Pat. No. 4,123,056 issued to Nakamatsu on Oct. 31, 1978. This references discloses a golf putter head having two connected and opposed members which are spaced apart. One of the members is adapted to strike a golfball such that the member vibrates to produce a sound by which a golfer can judge the area of the club head which strikes the golfball. The sounding member is in the shape of a tine with a vibrating free end, the tine being the ball-striking surface. Another attempt at creating a sound-producing golf putter is U.S. Pat. No. 5,160,144 issued to Maniatis on Nov. 3, 1992. This reference discloses a golf putter having tuning fork effects. The putter head is vertically sliced from the sole all the way to into the neck to form first and second opposing portions which produce tuning fork effects, namely, shaft vibrations and a corresponding tone. Yet another attempt at creating a sound-producing putter is U.S. Pat. No. 5,346,219 issued to Pehocki et al on Sep. 13, 1994. In this reference, a symmetrical golf putter head is formed of a center elongated bar member and two ball striking plate members affixed at both ends in spaced position on opposite sides of the center member. The opposing plates flex when the golfball is struck, and the flexure compensates for deflection and provides a more accurate roll in the selected direction.

In the above-described attempts at creating a sound-producing golf putter, either the tonal quality of the produced sound is inferior or the tone-producing members are so thin that they flex, thus adversely affecting the direction of the golfball. There is therefore a need in the art for a sound-producing golf putter which produces aesthetically pleasing high quality tones, yet which provides accurate putting.

SUMMARY OF THE INVENTION

In order to overcome the deficiencies in the prior art, the applicants have devised a golf putter which includes a rigid mid-section and two parallel, opposing tone-generating tines on either side. The tone generators are each held at the toe of the club head, being formed as an integral extension of a central member by cuts through the club head. Because the tone generators are formed using this structure, a volume and quality of sound can be produced from a relatively thick striking surface plate which has minimal flexure, thus producing accurate golf putting. The present golf putter is symmetrical and reversible for use by both left and right-handed golfers. Furthermore, as provided by the present golf putter, it has been found that it is desirable to have the mass of the club head distributed toward the toe which will resist twisting the golfclub about the shaft, which golfers want to avoid. The second rear facing tone generator vibrates sympathetically with the frequency of the striking face tone generator to enhance the quality and volume of the sound. The rear tine also distributes the weight of the golfclub head equally on either side of the shaft, thus providing even front-to-rear weight balance. Both tines are free-end vibrating members unobstructed for their full length.

In another embodiment of the present invention, the two sound-producing tines are both on the rear side of the club head with the striking face being provided by a flat, front facing surface of the main body of the club head to which the shaft is affixed. In this embodiment, the striking face is even more rigid, and the tines, even though they are more remote from the striking surface, still produce an acceptable volume and quality of sound. This embodiment provides the further possibility of having sound-producing tines of different lengths so that each tine produces a different tonal frequency. The most pleasing sound produced by this embodiment occurs when the frequencies of the two tines are chosen to be tonal harmonics of each other.

More specifically, the present invention comprises: a golfclub with a shaft and club head having a toe and a heel, the head being affixed to the end of the shaft; a plurality of sound-generating tines formed integrally with the club head; and the tines being of different lengths and producing different and complementary tonal frequencies when the club head strikes a golfball. The golfclub further includes a concave depression formed in the top surface of the club head proximate the toe, and the club shaft meets the head adjacent to a line which delineates the optimal golfball striking point on a face of the club head. An alternate embodiment of the present golfclub invention comprises: a shaft and a club head having a toe and a heel, the club head affixed to the end of the shaft; a plurality of soured-generating tines formed integrally with the club head; the tines formed by a front and a rear vertical cut made completely through the club head, the cuts being parallel; and the outer surface of said tines providing a ball-striking surface of the club head. The vertical cuts extend entirely through a heel of the club head, and the weighting of the club head is imbalanced toward the toe.

It is therefore the primary object of the present invention to provide a sounding golf putter which produces accurate golf putting. It is another object of the present invention to provide a sounding golf putter which produces a high quality musical tone. Other objects and advantages of the present invention will be readily apparent to those of ordinary skill in the art from the following drawings and description of the preferred embodiment.

BRIEF DESCRIPTION OF THE DRAWINGS

FIG. 1 is a top left front isometric view of the present golf putter invention.

FIG. 2 is a top sectional view taken from FIG. 1 as shown in that figure.

FIG. 3 is a bottom sectional view taken from FIG. 1 as shown in that figure.

DESCRIPTION OF THE PREFERRED EMBODIMENT

Figure 4:
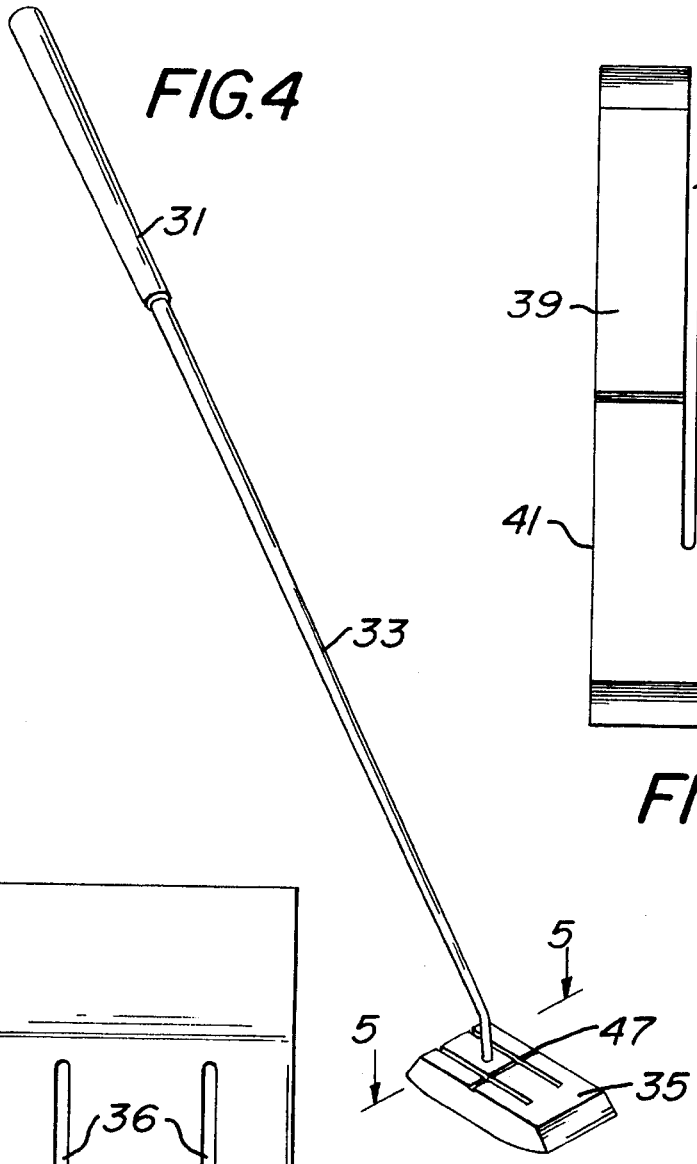
FIG. 4 is a top left front isometric view of a second embodiment of the present golf putter invention.

Referring to FIG. 1, a first embodiment of the present invention is a golf putter of fixed construction, including grip 11, shaft 13, and head 15.

Referring now to FIG. 2, a top view of the golf putter head illustrates its structure in greater detail. The head 15 includes right-side striking face 21, and left-side curved sounding tines 17 and 19 which are formed by vertical cuts 16 and 18. Striking line 22 indicates the optimal striking point along face 21. The golfclub head also includes a concave depression 25 which occurs from the removal of material from the top of the head in order to achieve a weighting which places the striking line 22 very close to the point where the shaft 13 meets the top of the club head.

Referring now to FIG. 3, a bottom sectional view illustrates that the sounding tines 17 and 19 have different lengths which are created by vertical cuts 16 and 18 which pass completely through the club head from top to bottom. The bottom of the club head is a smooth planar surface. When a golfball contacts striking face 21, tines 17 and 19 vibrate, producing a pleasing sound. The length of the tines is selected so that they generate different tonal frequencies, preferably tonal harmonics that produce a pleasing combined sound. If desired, a single tine version of this embodiment may be created by simply eliminating cut 18.

Referring now to FIG. 4, a second embodiment of the present invention is shown. As in the previous embodiment, the club construction is conventional, having a grip 31, a shaft 33, and head 35. Like the first embodiment, the head 35 in this embodiment also includes two sounding tines, except they are formed and located differently. Furthermore the weighting of the golfclub head is also much different. It can be seen that the striking line 47 and, hence, the desired striking point is moved considerably forward of the shaft 33. This construction provides a heavily toe-weighted imbalance which resists undesirable twisting torque about the shaft during the putting stroke.

Figure 5:
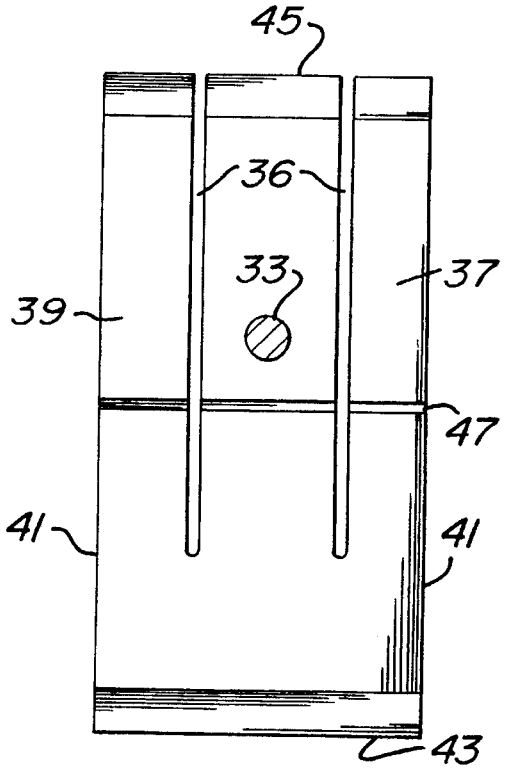
FIG. 5 is a top sectional view taken from FIG. 4 as shown in that figure.

Referring now to FIG. 5, top sectional view of the second embodiment shows vibrating tines 37 and 39 formed by vertical cuts 36 through the entire thickness of the golf putter head from top to bottom. As in the previous embodiment, the tines are free-end, vibrating bars; however, in this case, each produces the same frequency. Striking faces 41 are provided by the outside surface of the tines. Striking line 47 indicates the optimal point of ball contact. An important difference in this embodiment is the club head weight distribution from heel 45 to toe 43. As seen in FIG. 5, the tines 37 and 39 originate from the toe area which do not have any material removed from the top face as in the previous embodiment shown in FIGS. 1–3.

Figure 6:
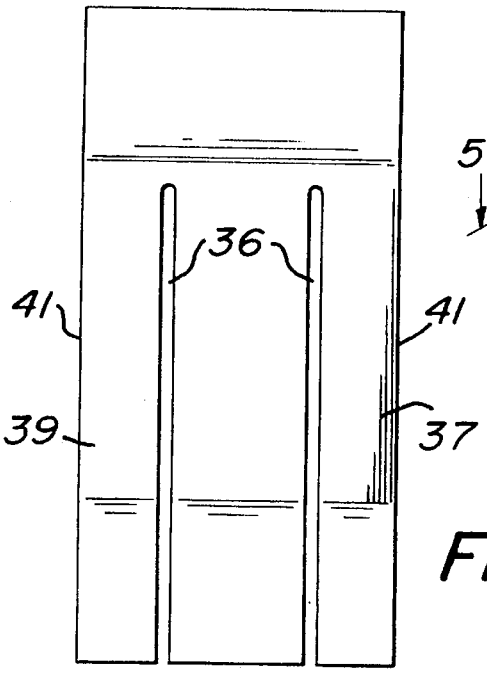
FIG. 6 is a bottom sectional view taken from FIG. 4 as shown in that figure.

FIG. 6 depicts a bottom view of the head of the club shown in FIGS. 4 and 5, and illustrates that the vertical cuts 36 pass entirely through the club head from top to bottom.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A golfclub, comprising:

a shaft, and a club head having a toe and a heel, said head affixed to the end of said shaft;

a plurality of sound-generating tines formed integrally with said club head; and said tines being of substantially different lengths, producing different and harmonic tonal sound frequencies when the club head strikes a golfball.

2. The golfclub of claim 1, further including a concave depression formed in the top surface of said club head proximate the toe.

3. The golfclub of claim 2, further including a line which indicates the optimal golfball striking point on a face of said club head located adjacent where said shaft meets said club head.

4. A golfclub, comprising:

a shaft, and club head having a toe and a heel, said club head affixed to the end of said shaft;

a plurality of sound-generating tines formed integrally with said club head;

front and rear vertical cuts made completely through said club head, said cuts being parallel and forming said tines integral with said club head, said club head thus being located between said tines; and the outer surface of said tines providing a ball-striking face of said club head.

5. The golfclub of claim 4, further described in that said vertical cuts extend entirely through a heel of said club head.

6. The golfclub of claim 5, further described in that the weighting of said club head is imbalanced toward a toe of said club head.

7. A golfclub, comprising:

a shaft, and a club head having a toe and a heel, said head affixed to the end of said shaft;

a plurality of sound-generating tines formed integrally with said club head; and said tines being of different lengths and producing substantially different tonal sound frequencies when the club head strikes a golf ball.

8. The golf club of claim 7, further described in that said tonal sound frequencies are harmonic.

9. A golf club, comprising:

a shaft and a club head having a toe and a heel, said head affixed to the end of said shaft;

first and second vertical cuts made completely through said club head and extending horizontally from the outer edge of the heel to a point short of the end of the toe, said cuts being parallel; and a plurality of sound-generating tines formed integrally with said club head, said tines being free end vibrating bar-type sound generators.

* * * * *